US007150545B1

(12) United States Patent
Hui

(10) Patent No.: US 7,150,545 B1
(45) Date of Patent: Dec. 19, 2006

(54) MULTI POSITIONED LAMP HARP

(75) Inventor: Gary Hui, Kowloon (CN)

(73) Assignee: Mastercraft International USA, Inc., Jonesboro, AR (US)

( * ) Notice: Subject to any disclaimer, the term of this patent is extended or adjusted under 35 U.S.C. 154(b) by 0 days.

(21) Appl. No.: 11/396,319

(22) Filed: Apr. 3, 2006

(51) Int. Cl.
*F21V 21/00* (2006.01)

(52) U.S. Cl. ..... 362/417

(58) Field of Classification Search ..... 362/417
See application file for complete search history.

(56) References Cited

U.S. PATENT DOCUMENTS 2,408,522 A * 10/1946 Leef ..... 362/452
5,412,554 A * 5/1995 Lee ..... 362/449
5,775,352 A * 7/1998 Obitts ..... 135/69
2005/0073842 A1* 4/2005 Pape et al. ..... 362/277

* cited by examiner

*Primary Examiner*—Laura K. Tso
(74) *Attorney, Agent, or Firm*—Dennis B. Haase

(57) ABSTRACT

A harp for supporting a shade on an illuminating device in which the harp is extensible and retractable to a desired height, in which a button in the upper member of the harp is received in one of several openings in the lower legs and is spring biased to hold the button therein until moved manually.

7 Claims, 1 Drawing Sheet

MULTI POSITIONED LAMP HARP

The present invention relates to harps which support a shade or the like on a lamp, and, more particularly, to a harp which is extensible to permit appropriate coverage about the illuminating element of a lamp by extending or contracting the harp in response to the length of the shade.

BACKGROUND OF THE INVENTION

1. Field of the Invention

When a person buys a lamp in a retail establishment, it typically comes with a shade affixed. Increasingly, however, the consumer has options, and a lamp base and a shade support are sold separately from the shade, and the consumer then has a choice of many different shades in a variety of shapes and sizes.

The usual support of shades on lamps is referred to as a harp. Harps come in sizes which relate proportionateley to the size of the lamp. When a consumer elects a particular shade as a result of one's personal taste, it may be of a length which does not fit on the harp sold with the lamp. Under such circumstances, the consumer either seeks out a different harp, and they are not exactly easy to locate, or the consumer buys a new shade which is compatible with the existing harp. Neither option is particularly attractive, and it is to that concern that the harp of the present invention is directed.

2. Overview of the Prior Art

The concept of a shade holder that is extensible and retractable is not a new concept. See, for example, Ewing U.S. Pat. No. 1,235,020 which shows a shade holder having a series of upstanding rods which are mounted in support arms and held in a particular position by thumb screws.

While Ewing uses thumb screws which engage the rods and hold them frictionally, Lee, in his U.S. Pat. No. 5,412,554, accomplishes the same result by drilling screw holes in the rods and threading a set screw into one of those holes.

Smurik, in his U.S. Pat. No. 2,593,704, employs yet another means of securing the position of the upper portion of a harp in a predetermined position relative to the lower section, by using finger pieces which insert protuberances in slots in the upper legs of the harp to secure the segments of the harp at a predetermined position.

While accomplishing the same objectives as his forerunners, Leef, U.S. Pat. No. 2,408,522, uses yet another means of choosing and holding the position of the harp at a desired height.

Yet another method of positioning and holding the harp in a predetermined position is found in Auerbach U.S. Pat. No. 1,946,959. Auerbach cut notches in the legs and then uses what he calls "caps" to lock into the notches to hold the harp in place.

There are several others along the same general lines, among them, Berger reissue patent number 20,170; Shoglow U.S. Pat. No. 2,895,941 and Pape et al. U.S. Pat. No. 6,971,773. All of these patents appear to have issued because each uses a different means of securing the harp at the desired height.

SUMMARY OF THE INVENTION

With the foregoing environment in mind, and with due regard to the extent of the prior art, it is an objective of the present invention to provide to the consumer an exceptionally stable multi positioned harp for a lamp or the like.

It is another objective of the present invention to provide such a multi positioned harp which permits positive control of the predetermined position elected and to permit election and affixing of that position rapidly, while requiring a minimum of dexterity.

Additional objects and advantages of the present invention will occur to those skilled in the art by a reading of the following Detailed Description of a Preferred Embodiment taken in conjunction with the drawings, wherein:

DETAILED DESCRIPTION OF A PREFERRED EMBODIMENT

Figure 1:
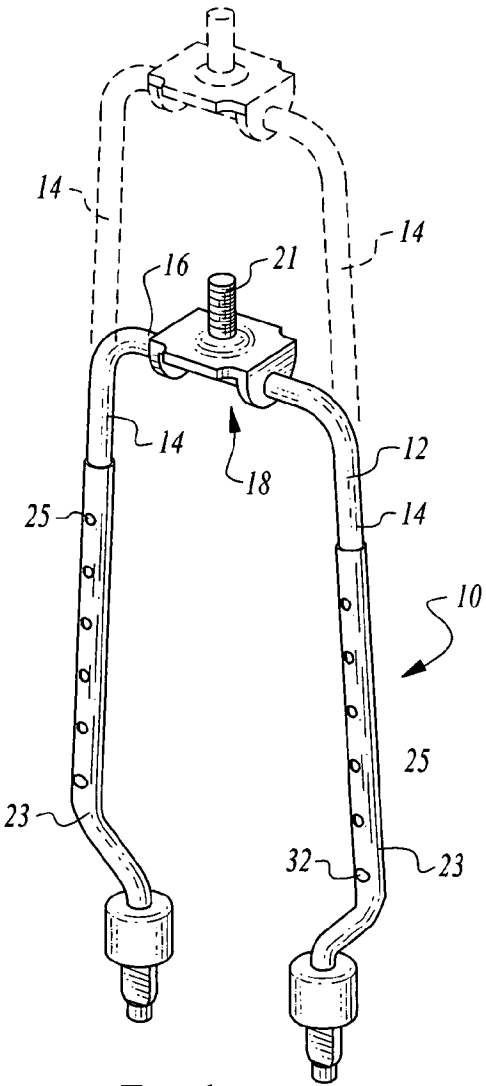
FIG. 1 is a pictorial depiction, shown in perspective, of a harp constructed in accordance with the present invention, and further indicating, in shadow, the harp in an extended position.

With reference now to the drawing and initially to FIG. 1, a harp 10 is shown, which has been constructed in accordance with the present invention.

The environment surrounding harps, such as that of the present invention, includes an illuminating device such as a lamp with a shape circumscribing the illuminating element, none of which is illustrated here, since it is well known within and without the art.

Harps in general, and the harp 10, in particular, are structures which support a shade or the like on a lamp about an illuminating element on the lamp, both as a decorative device and to disperse, and perhaps soften, the beam emanating from the illuminating element.

The fundamental structure of the harp is generally familiar to consumers and those skilled in the art alike. It comprises a unitary upper, "U" shaped member 12, having downwardly extending linear, parallel upper legs 14. The legs 14 are separated by a generally horizontal extender 16. What has become known in the art as a finial 18 is situate on the extender 16 and is provided with an upstanding stud 21 which is standard in the industry and is used to secure the shade, or similar device, to the harp.

Figure 2:
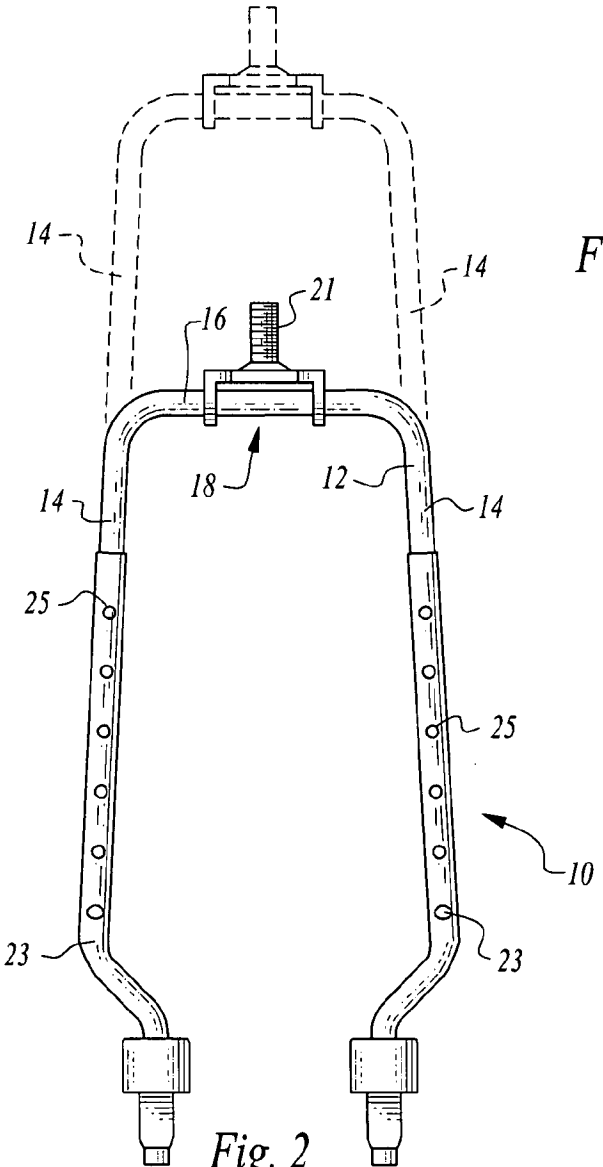
FIG. 2 is a side elevation of the harp of FIG. 1.

The structure of the harp 10 includes a pair of lower legs 23. The legs 23 are tubular and are of such diameter as to receive the upper legs 14 therein, as may be seen in FIGS. 1 and 2. Each of the legs 23 is formed with a column of openings 25, which are part of the mechanism which permits the user to select and secure the upper portion of the harp relative to the legs 23 in order that the harp is capable of positioning a shade to be mounted thereon.

In today's commercial world, shades come in a variety of shapes and sizes and the owner of a particular illuminating device requiring a lamp shade, may elect a new or different shade for a variety of reasons. All shades may not fit the lamp correctly, and if there is no way to adjust the harp, the shade selection becomes far more limited. The harp 10 of the present invention provides to the consumer a simple and secure mechanism for the selective positioning of the upper member 12 relative to the lower legs 23 of the harp 10.

Figure 3:
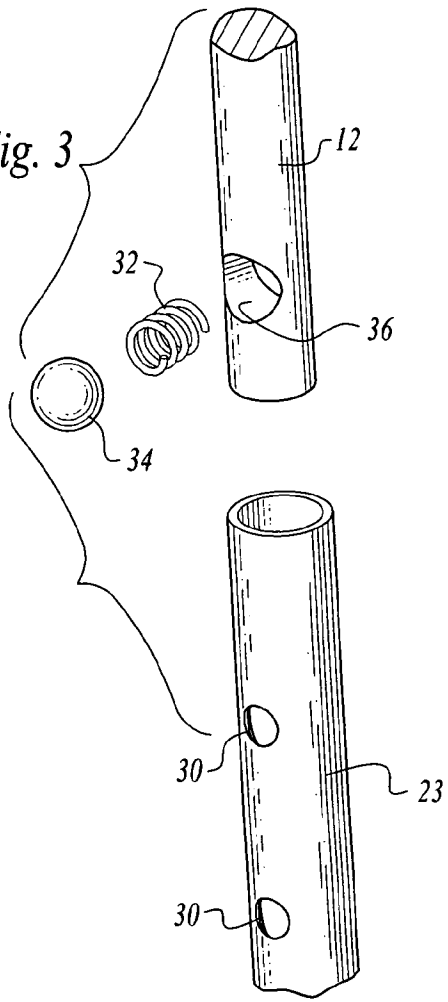
FIG. 3 is an exploded view of the mechanism that locks the upper leg portion of the harp in a predetermined position.

With particular reference to FIG. 3, the lower legs 23 are formed with a column of spaced openings 30 along the longitudinal axis of each such leg. In order to provide easy access, as illustrated, there is a column of openings found along the forward surface of each leg. The complimentary upper leg 12 is provided with a series of buttons, or detents,

32, which are biased outwardly, preferably by springs 34, which are situate in recesses 36 in the legs.

The buttons protrude by a predetermined amount from the pocket or recess in the leg, and are depressable inwardly so that the outer extremity of the button is flush with the leg. While the buttons shown are generally circular, it will be appreciated that they may be of any particular configuration, e.g., spherical, cylindrical and even square, without departure from the invention.

It will now be appreciated that by manually depressing the button, or detent, the upper leg can be moved relative to the lower leg, thereby extending or contracting the harp 10 to fit a chosen shade. When the appropriate height is achieved, the spring 34 urges the button into an adjacent opening 25 and the harp is secured and stable at the height desired.

Those skilled in the art may conceive of slightly different structural elements from those specifically taught in the specification. It will be appreciated that such variations are within the contemplation of the invention which is defined by the forthcoming claims.

The invention claimed is:

1. In a harp for use in conjunction with an illuminating device, such as lamp, to support a shade, said harp being selectively positionable at a variety of heights, comprising, an upper member having depending upper legs, a pair of lower legs, said lower legs being engaged with the illuminating device;

said lower legs each having a column of spaced openings therein, said upper legs each having a button resiliently mounted therein, a spring normally biasing said button outwardly from said legs, said button and said openings being aligned such that when said upper legs are telescopingly received in said lower legs, said button becomes engaged in a selected one of said openings; and a finial mounted to said upper legs for receipt and support of a shade.

2. The harp of claim 1, wherein a coil spring is provided in each of said lower legs to bias said button outwardly therefrom.

3. The harp of claim 1, wherein said upper member includes an extender engaged with said upper legs to position said upper legs in spaced relation to one another.

4. The harp of claim 3, said extender being generally transverse to said upper legs.

5. The harp of claim 1, wherein said upper legs are linear.

6. The harp of claim 2, said extender being generally transverse to said upper legs.

7. The harp of claim 2, wherein said upper legs are linear.

* * * * *